US006035580A

United States Patent [19]

Carter

[11] Patent Number: 6,035,580

[45] **Date of Patent: *Mar. 14, 2000**

[54] SELF-PRIMING DRAIN GUARD SIPHON

[76] Inventor: Christopher E. Carter, 10914 Parker Vista Pl., Parker, Colo. 80134

[ * ] Notice: This patent issued on a continued prosecution application filed under 37 CFR 1.53(d), and is subject to the twenty year patent term provisions of 35 U.S.C. 154(a)(2).

[21] Appl. No.: 08/663,477

[22] Filed: Jun. 13, 1996

[51] Int. Cl.[7] ..... E04D 13/076

[52] U.S. Cl. ..... 52/12; 52/16; 210/463

[58] Field of Search ..... 52/12, 14, 16; 210/162, 163, 164, 165, 166, 460, 473, 463

[56] References Cited

U.S. PATENT DOCUMENTS

| | | | |
|---|---|---|---|
| 316,578 | 4/1885 | Schumann et al. | 210/162 |
| 524,668 | 8/1894 | Hawkins | 210/460 |
| 571,711 | 11/1896 | Twist . | |
| 803,316 | 10/1905 | Vogel . | |
| 1,434,254 | 10/1922 | Sanders | 210/163 |
| 1,721,472 | 7/1929 | Rose . | |
| 1,811,728 | 6/1931 | McKee . | |
| 1,937,732 | 12/1933 | Tverdak | 210/162 |
| 2,013,761 | 9/1935 | Murphy | 210/162 |
| 2,059,071 | 10/1936 | Weyand . | |
| 2,807,368 | 9/1957 | Blau | 52/12 X |
| 3,426,487 | 2/1969 | Forte | 52/12 X |
| 4,107,929 | 8/1978 | Ebeling et al. | 61/14 |
| 4,112,691 | 9/1978 | Ebeling et al. | 405/119 |
| 4,247,397 | 1/1981 | Dobosi | 210/162 |
| 4,285,812 | 8/1981 | Stoltz | 210/162 |
| 4,460,462 | 7/1984 | Arneson | 210/163 |
| 4,615,153 | 10/1986 | Carey | 210/162 X |
| 4,834,138 | 5/1989 | Dellasso | 137/590 |
| 5,302,283 | 4/1994 | Meuche | 210/162 |
| 5,409,602 | 4/1995 | Sorenson | 210/162 |
| 5,536,406 | 7/1996 | Silva | 210/460 |

FOREIGN PATENT DOCUMENTS

| | | | |
|---|---|---|---|
| 35134 | 3/1965 | Finland | 52/12 |
| 2053630 | 5/1972 | Germany | 52/12 |

*Primary Examiner*—Michael Safavi
*Attorney, Agent, or Firm*—Head, Johnson & Kachigian

[57] ABSTRACT

A self-priming drain guard siphon insertable into the opening of any reservoir drain subjected to accumulation of fluid transported debris comprising an outer shell (17) enclosing an inner priming chamber (20) held upright on the bottom of a reservoir by support tabs (18). Priming chamber (20) is comprised of inlet openings (22), a horizontal chamber (20*a*), a vertical chamber (20*b*), and an outlet opening (24). Inlet openings (22) are each positioned above and between adjacent support tabs (18) and vertical chamber (20*b*) at an elevation slightly higher than the bottom of a reservoir. Inlet openings (22) are cumulatively sized to approximate flow capacity of horizontal chamber (20*a*) and are positioned on the underside of horizontal chamber 20*a* to prevent lateral passage and direct contact with median sized debris. Horizontal chamber 20*a* is sized to approximate the flow capacity of vertical chamber 20*b*. The overall length of horizontal chamber (20*a*) is predetermined to accommodate inlet openings (22), vertical chamber (20*b*), and to bridge across the reservoir drain opening. Vertical chamber 20*b* is sized to approximate the flow capacity of the reservoir drain opening. Horizontal chamber (20*a*) communicates directly with vertical chamber (20*b*) to form a fluid transmitting conduit which self-primes with rising fluid elevation. Airless flow develops within priming chamber (20) when outer shell (17) becomes submerged.

3 Claims, 6 Drawing Sheets

SELF-PRIMING DRAIN GUARD SIPHON

BACKGROUND—FIELD OF INVENTION

This invention relates to a new and useful drain protection device which utilizes a self-priming siphon to remove liquid from a reservoir while protecting a drain opening from obstructed clogging in environments subject to frequent and large quantities of debris. More specifically, this invention is primarily used to protect the opening of a downspout in a rain gutter system.

BACKGROUND—DESCRIPTION OF PRIOR ART

Downspout clogging in a rain gutter system has long been a problem in the effective removal of roof runoff from light commercial and residential structures. Downspout clogging at the inlet of a gutter always restricts, and in many cases, obstructs water flow through the downspout resulting in water overflow of the gutter which often causes soil erosion and foundation problems due to collection of water adjacent to a structure. In addition, maintenance activities involved with clearing debris from gutters and downspouts can be hazardous due to injuries associated with falls and interaction with power cables.

Several novel inventions have attempted to solve this problem. The most common solution has been to insert a screen or strainer device over or into the opening of a downspout to separate debris from, the water flow. U.S. Pat. No. 571,711 to Twist (1896) specifies a two-sided inclined screen positioned over a downspout opening to collect debris for eventual disposal over the upper edges of a gutter when water is coincident at the same elevation. This feature is undesirable since it allows water to overflow the gutter, and further assumes that all of debris will float free of the screen. U.S. Pat. No. 4,247,397 to Dobosi (1981) uses a single row of inclined rods or fingers placed over a downspout opening to filter debris from the water flow. This design asserts that all separated debris will dry out upon the rods and be blown out of the gutter by the wind. In reality, this is seldom the case. Many downspouts lie beneath shade trees which block out sunlight needed for drying. In addition, the presence of trees and the partially enclosed nature of gutters deflect wind currents needed to lift and remove debris.

U.S. Pat. Nos. 1,811,728 to McKee (1931) and 2,059,071 to Weyand (1936) are typical examples of wire or cage type strainers inserted into the opening of a downspout and intended to filter the debris from the water. The main difficulty with this arrangement is that wet leaves and the like ultimately adhere to the outer surface of the cage and block off all water access paths to the downspout. This results in flow backup and causes gutter water spillage onto the ground.

Several variations of the strainer/cage idea have been developed as well. U.S. Pat. No. 803,316 to Vogel (1905) utilizes a combination shield/strainer which is positioned over a downspout opening to accept water through an inclined perforated plate shaped to match the cross-section of the gutter. While this arrangement initially would be effective in separating debris from the water flow, accumulation of wet leaves and the like, eventually cover the small drain inlet holes and cause the downspout to become inoperable resulting in gutter overflow and water spillage onto the ground. U.S. Pat. No. 4,285,812 to Stoltz (1981) proposes use of a wire cage mounted onto a flow restricting device placed into a downspout opening to reduce runoff load into a sewer. The flaw in this idea is that most modern day sewers are designed to handle the load contributed by new and existing commercial and residential roof sources. Unfortunately, the only new results experienced with this device are decreased downspout flow capacity, strainer clog from wet leaves and the like, and gutter overflow spillage onto the ground. U.S. Pat. No. 5,302,283 to Meuche (1994) employs a plurality of U-shaped ribs placed into the downspout opening and perpendicular to the direction of flow. The ribs are arranged such that clear access for water is provided on each side facing a gutter wall. The intent of this design is to block debris flowing toward the downspout while accepting water from the side entrances. This configuration is ineffective since transportation of leaves and debris is not limited to water conveyance. Adjacent trees which deposit leaves and debris from above, eventually smother both side water access paths causing flow backup and water spillage onto the ground. U.S. Pat. No. 5,409,602 to Sorenson (1995) is an elongated version of the cage-type strainers and merely prolongs the time needed for total obstruction from wet debris.

All siphon related roof drainage devices were associated with water removal from flat roofs and not found to be employed in a typical gutter trough/downspout setting. U.S. Pat. Nos. 4,107,929 and 4,112,691 to Ebeling (1978) use enclosed devices set in a collection pan connected to a lower vertical discharge pipe. These drain devices feature a series of lateral holes which accept radial flow as the collection pan fills. When these devices become submerged, siphon action is induced thus drawing additional roof surface water into the pan until the water level lowers and breaks the seal. Again, these devices are subject to total obstruction from accumulation of wet debris and the like onto the sides of the strainer surfaces.

Nevertheless, all drain guard devices heretofore known suffer from a number of disadvantages:

(a) use of a device that filters debris and drains water through coincident openings;

(b) accumulation of debris onto strainer surfaces restricts and eventually blocks all available drainage capacity;

(c) flow volume into drain decreases proportionately with water elevation;

(d) obstructed low flow rates near drain entrance encourage fine particle sedimentation and debris decomposition;

(e) frequent short term maintenance required to clear accumulated debris from strainer surfaces;

(f) dependence on forces of nature (ie. water, wind, sun, etc.) to clear debris from strainer device;

(g) moderately difficult and time consuming to manufacture.

OBJECTS AND ADVANTAGES

Accordingly, several objects and advantages of my invention are:

(a) to provide a device that filters debris and drains water through separate openings;

(b) to provide a device which prevents accumulation of debris onto strainer surfaces thereby allowing unobstructed drainage capacity;

(c) to provide a device which periodically utilizes a self-priming siphon to supply greater flow volume with decreasing water surface elevation;

(d) to provide a device which promotes high flow rates near the drain entrance and discourages fine particle sedimentation and debris decomposition;

(e) to provide a device which is maintenance free;

(f) to provide a device which does not depend on forces of nature to clear accumulated debris;

(g) to provide a device which can be easily and quickly manufactured.

Further objects and advantages of my invention will become apparent from a consideration of the drawings and ensuing description.

DRAWING FIGURES

FIG. 1 is a perspective view of the present invention in a configuration suitable for insertion into a downspout installed at the end of a section of guttering.

FIG. 1*a* is a perspective view of an alternate embodiment of the present invention in a configuration suitable for insertion into a downspout installed at the end of a section of guttering.

REFERENCE NUMERALS IN DRAWINGS

| | | | |
|---|---|---|---|
| 10 | roof surface | 17 | outer shell |
| 11 | eave | 18 | support tab downspout gap |
| 12 | gutter | 20 | priming chamber |
| 13 | gutter bottom | 20a | horizontal chamber |
| 13a | side wall | 20b | vertical chamber lateral gap |
| 13b | end plate | 22 | inlet opening |
| 14 | downspout | 24 | outlet opening |
| 15 | gutter opening | 26 | alternate embodiment |
| 16 | preferred embodiment | 28 | support ledge |

DESCRIPTION OF PREFERRED T-SHAPED EMBODIMENT—FIGS. 1, 2 TO 6, 13 AND 15

Figure 1:
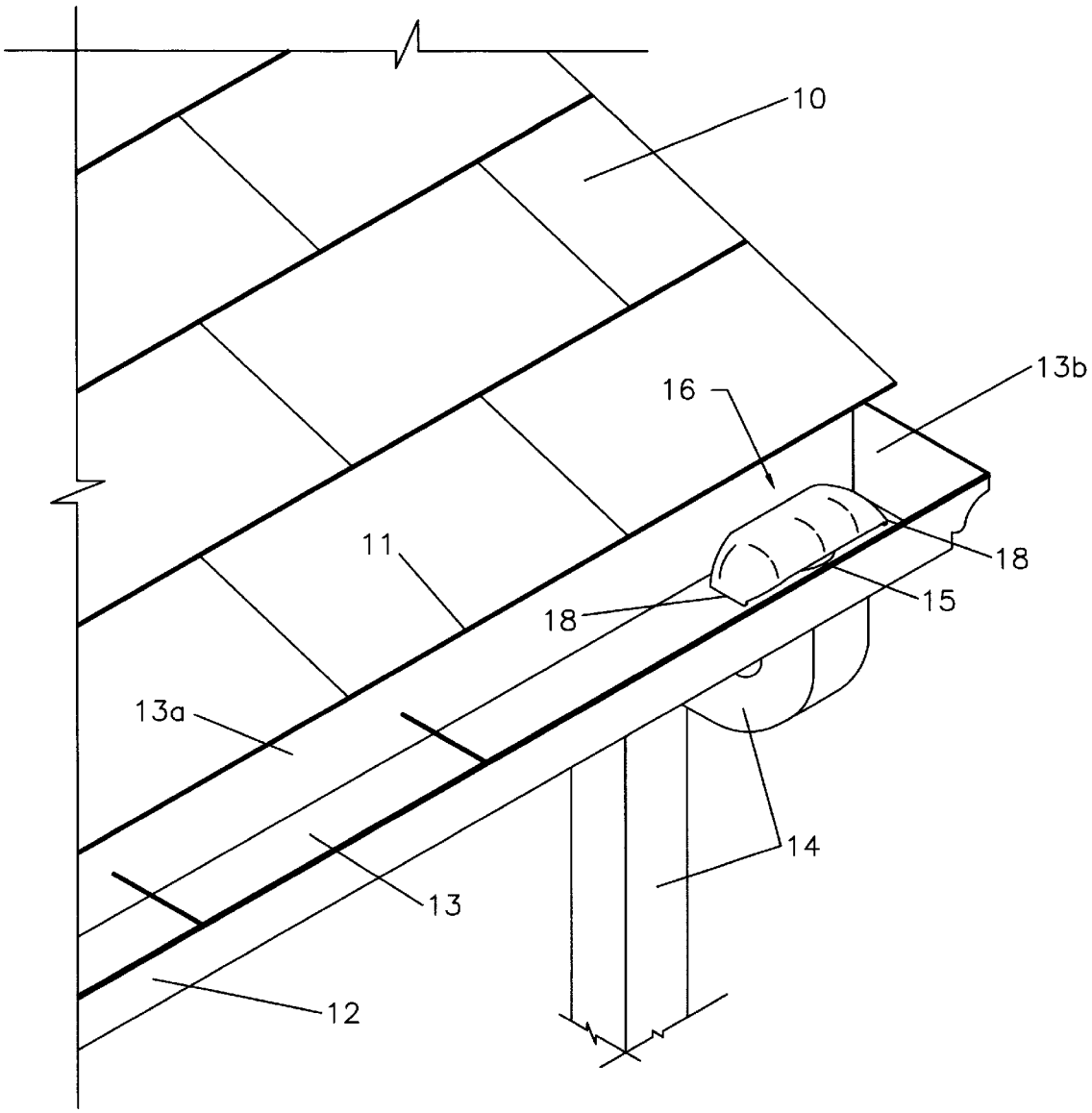

A typical arrangement of a preferred embodiment 16 for a gutter/downspout application is shown in FIG. 1 This arrangement could be found on most residential or light commercial structures and consists of a roof surface 10 which is sloped downward to an eave 11. Eave 11 is underlain by a gutter 12 for its entire length. Gutter 12 is comprised of a bottom 13, side walls 13*a,* and end plate 13*b*. A downspout 14 is connected to a gutter opening 15 in bottom 13 and at one end of gutter 12. Preferred embodiment 16 is inserted between side walls 13*a* into gutter opening 15 and supported onto bottom 13 by support tabs 18.

Figure 2:
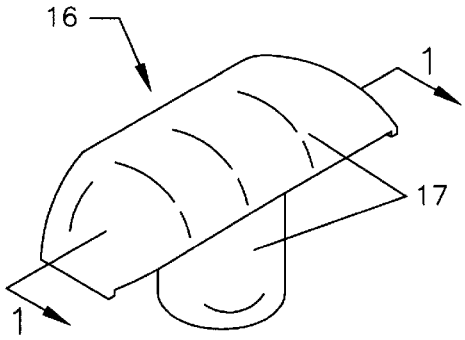
FIG. 2 is a perspective view of the present invention.
Figure 4:
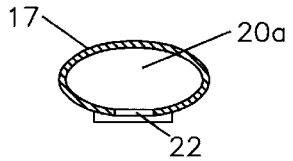
FIG. 4 is a sectional view of the present invention along line 2—2 of FIG. 3.
Figure 5:
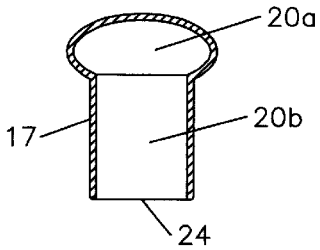
FIG. 5 is a sectional view of the present invention along line 3—3 of FIG. 3.
Figure 3:
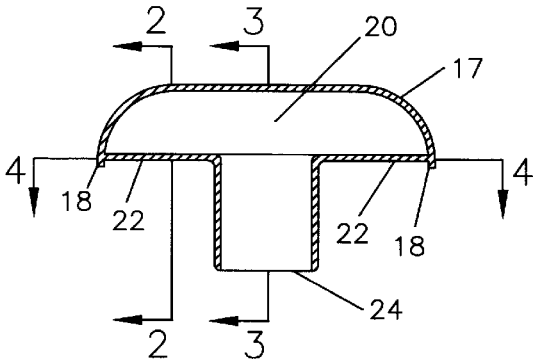
FIG. 3 is a sectional view of the present invention along line 1—1 of FIG. 2.
Figure 6:
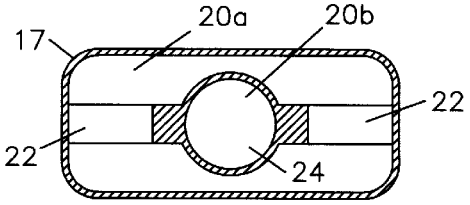
FIG. 6 is a sectional view of the present invention along line 4—4 of FIG. 3.

FIG. 2 shows a perspective view of preferred embodiment 16 with an outer shell 17. It is typically manufactured in two halves from corrosion and sunlight resistant plastic, metal, or other suitable materials, all having a specific gravity greater than that of water, then mechanically, chemically, or thermally joined along section line 1—1, to form a one piece unit.

FIGS. 3 through 6, 13, and 15 show sectional, front, and side views, respectively, of preferred embodiment 16 wherein like numerals represent like parts. An enclosed priming chamber 20 is held upright by support tabs 18 on each side of gutter opening 15. Support tabs 18 also act as a water and debris deflector, and have a width, typically shown in FIG. 15, less than gutter bottom 13.

Figure 13:
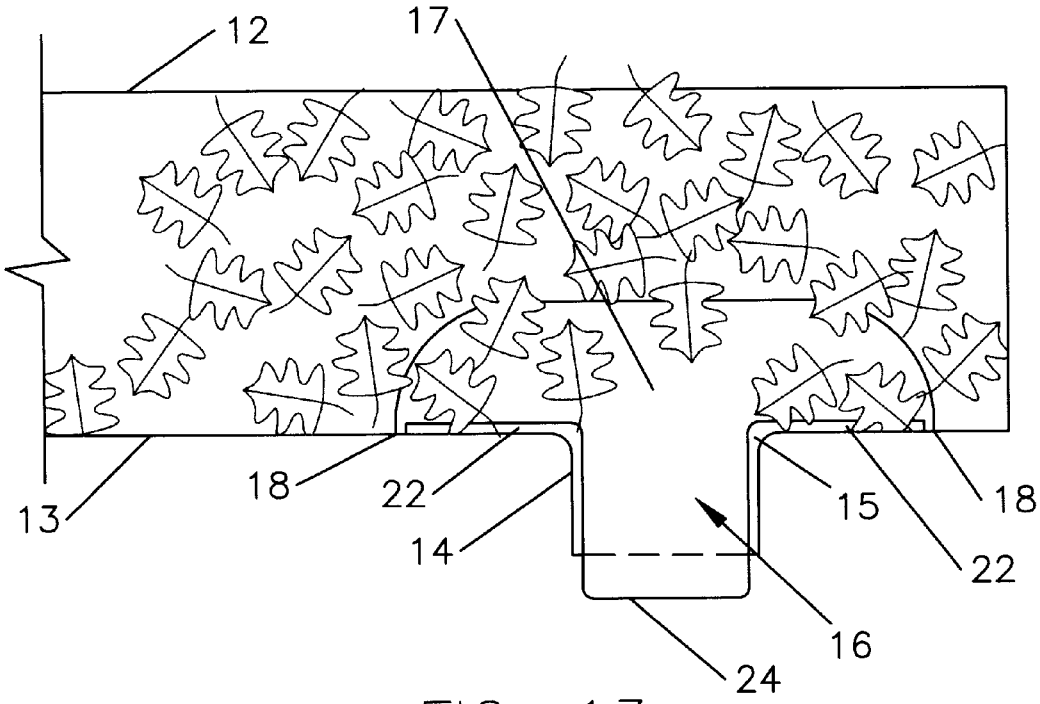
FIG. 13 is a front view of the present invention installed in a typical gutter/downspout arrangement which illustrates its debris deflecting characteristics.

Priming chamber 20 is comprised of inlet openings 22, a horizontal chamber 20*a,* a vertical chamber 20*b,* and an outlet opening 24. Inlet openings 22 are each positioned above and between adjacent support tabs 18 and vertical chamber 20*b* at an elevation slightly higher than gutter bottom 13 as shown in FIG. 13. Inlet openings 22 can be slots, a series of holes, or the like, but each are cumulatively sized to approximate flow capacity of vertical chamber 20*b*. The elevation of inlet openings 22 should be selected such that passage of median sized debris which could obstruct inlet openings 22 would be prevented from laterally entering through the gap formed by support tabs 18, outer shell 17, and gutter bottom 13.

Figure 15:
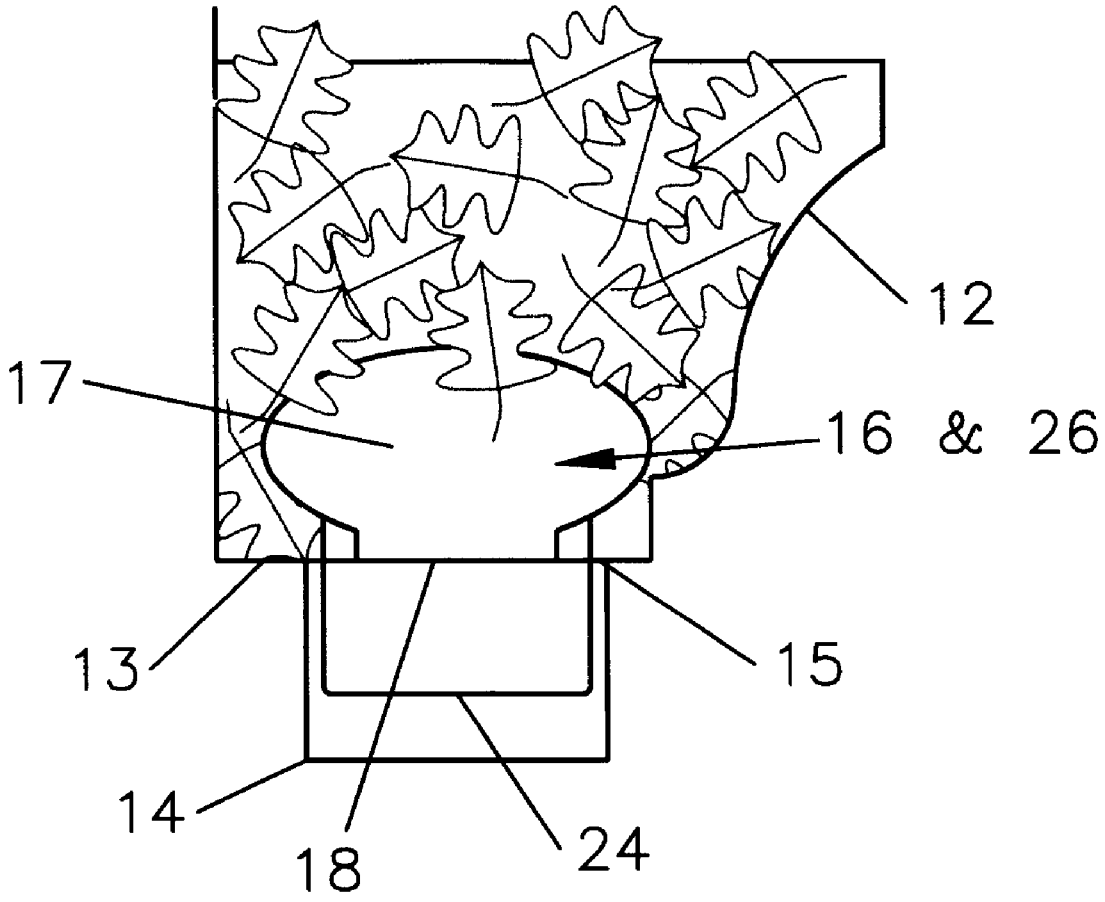
FIG. 15 is a side view of the present invention and an alternate embodiment installed in a typical gutter/downspout arrangement which illustrates its debris deflecting characteristics.

Horizontal chamber 20*a* can be of any desirable shape, but is intended to have its upper surface elevation as low as possible in relation to the top edge elevation of gutter 12, shown in FIGS. 13 and 15, and sized to approximate the flow capacity of vertical chamber 20*b*. The overall length of horizontal chamber 20*a* would only be that necessary to accommodate inlet openings 22, vertical chamber 20*b,* and that needed to bridge across gutter opening 15.

Vertical chamber 20*b* communicates directly with horizontal chamber 20*a* and can be of any desirable shape, but is intended to approximate the flow capacity of, and fit loosely into, gutter opening 15. Outlet opening 24 is the downward limit of vertical chamber 20*b* and terminates at an elevation lower than inlet openings 22 into downspout 14.

In the preferred embodiment, inlet openings 22 are slots, horizontal chamber 20*a* is ellipsoidal, and vertical chamber 20*b* is cylindrical.

OPERATION OF PREFERRED T-SHAPED EMBODIMENT—FIGS. 3, 4, 13 AND 15

Over time, debris in the form of leaves, pine needles, trash, silt, tennis balls, and the like is transported by gravity, rain, and wind into roof gutter 12. If left unprotected, gutter opening 15 eventually becomes clogged or obstructed as a result of accumulation and compaction of debris in this area. This occurs during two separate processes. First, during non-rainy periods, debris from trees or other sources falls into gutter 12 by gravity and/or wind and piles up in and around gutter opening 15. Second, during rainy periods or snowmelt, upstream water carries debris downstream which also deposits in and around gutter opening 15. The resulting debris pile covers and obstructs water flow into gutter opening 15 which, over time, causes sediment build up and muck production from debris decomposition, which eventually closes gutter opening 15 altogether. The same outcome is experienced when prior-art strainers are used—the resulting debris pile eventually covers and obstructs water flow through these devices, and shuts down gutter opening 15 altogether.

Installation of preferred embodiment 16 prevents this from occurring. Referring now to FIGS. 13 and 15, preferred embodiment 16 is inserted into gutter opening 15 and positioned onto gutter bottom 13 upon support tabs 18. As debris accumulates around outer shell 17, it forms a tight matrix from twigs, leaf stems, pine needles, and the like which form numerous voids. These voids convey water through the debris matrix which, depending on the flow volume, cause the water to drain or pool through and around outer shell 17.

Operation of preferred embodiment 16 can occur in either one of two phases: priming phase or siphon phase. Operation in the priming phase is most common, and exists during initial and/or low flow conditions. During rainstorms or snowmelt water flows through debris pile voids and initially drains through downspout gaps 19 which exist between gutter opening 15 and outer shell 17 of vertical chamber 20*b*. As flow volume increases and overwhelms downspout gaps 19, water level rises and passes between the lateral gap 21 formed by support tabs 18, outer shell 17, and gutter bottom 13. It then continues through inlet openings 22 where it creates an air seal, and enters priming chamber 20. Flow proceeds through horizontal chamber 20*a* and vertical chamber 20*b* until it concludes with discharge through outlet opening 24 into downspout 14. This stage of water drainage is governed by gravity and acts to prime the inner walls of horizontal chamber 20*a* and vertical chamber 20*b*.

The siphon phase develops when water elevation in gutter 12 rises to a level where preferred embodiment 16 becomes submerged. At this point, horizontal chamber 20*a* and vertical chamber 20*b* become fully primed with water and cause airless flow to develop. During this phase, negative water pressure is generated at inlet openings 22 which produce high velocity flow, and cause small debris adjacent to this area, to be sucked into priming chamber 20. This feature prevents sediment and muck build-up, and provides a self-cleaning mechanism which is maintenance free, and independent of the forces of nature for debris removal. Flow volume is also maximized during this phase since water is delivered in a greater quantity to downspout 14 than would normally be experienced during gravity flow which is mixed with air. Therefore, flow during the siphon phase also effectively increases drainage capacity of an existing gutter system.

Airless flow continues in this manner until the water level in gutter 12 drops to the elevation of inlet openings 22, and breaks the air seal created during the priming phase. At this point, the priming phase resumes until all water in gutter 12 has been removed either through inlet openings 22 or through the small gaps created between gutter opening 15 and outer shell 17 of vertical chamber 20*b*.

DESCRIPTION OF ALTERNATE L-SHAPED EMBODIMENT—FIGS. 1*a*, 7 TO 12, 14 and 15

Figure 1A:
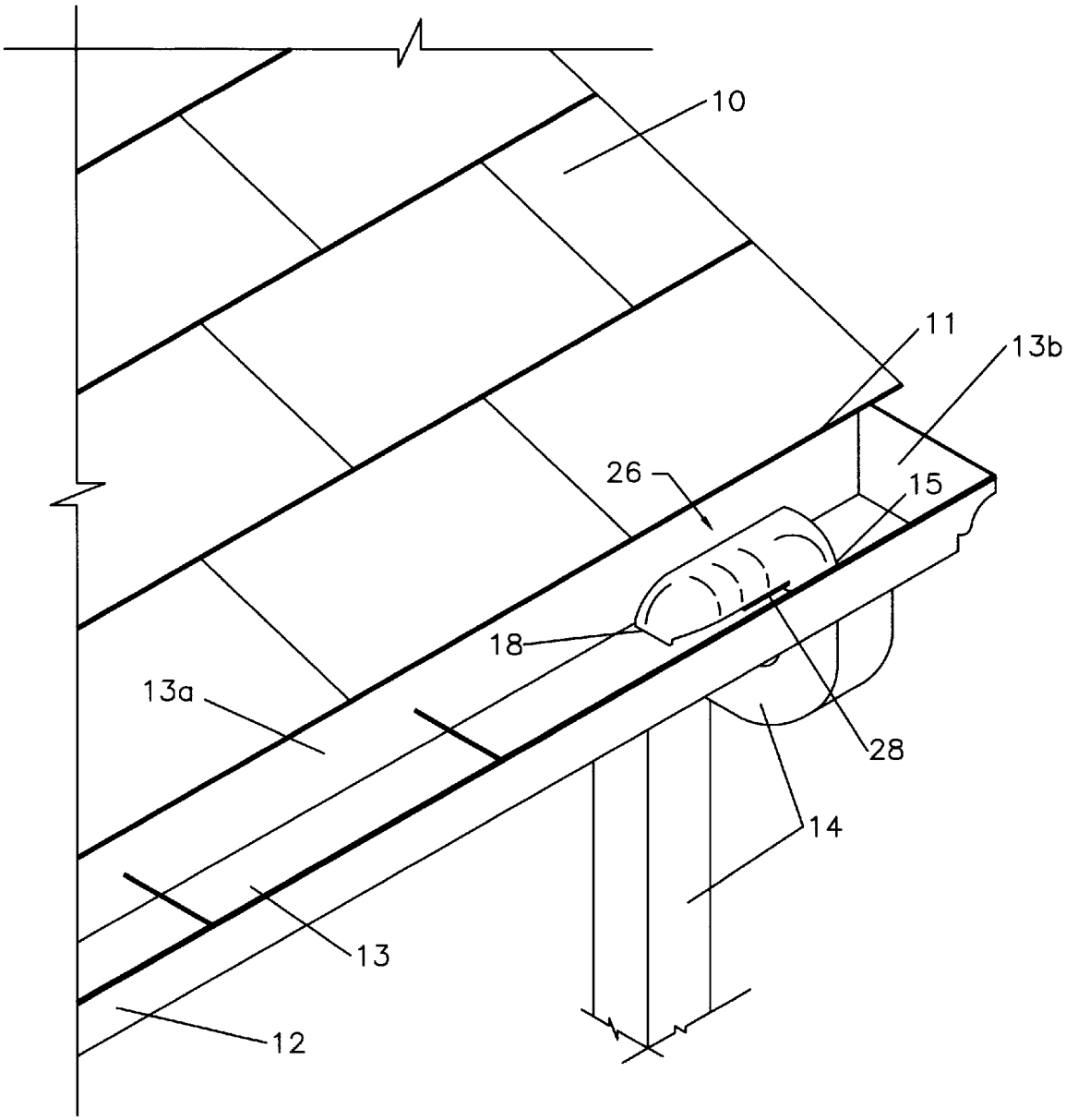

A typical arrangement of a alternate embodiment 26 for a gutter/downspout application is shown in FIG. 1*a* This arrangement can be found on most residential or light commercial structures and consists of a roof surface 10 which is sloped downward to an eave 11. Eave 11 is underlain by a gutter 12 for its entire length. Gutter 12 is comprised of a bottom 13, side walls 13*a*, and end plate 13*b*. A downspout 14 is connected to a gutter opening 15 in bottom 13 and at one end of gutter 12. Alternate embodiment 26 is inserted between side walls 13*a* into gutter opening 15 and supported onto bottom 13 by a support tab 18 and a support ledge 28.

Figure 7:
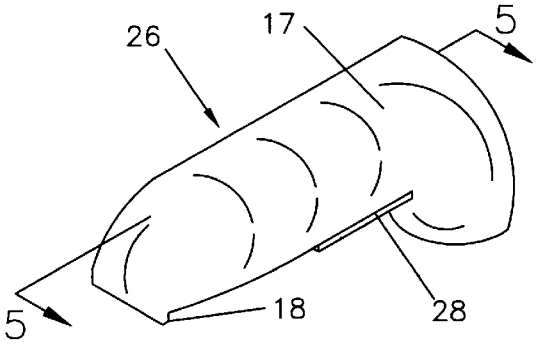
FIG. 7 is a perspective view of an alternate embodiment of the present invention.
Figure 9:
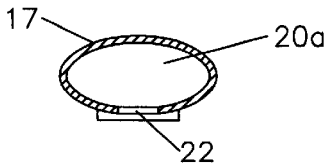
FIG. 9 is a sectional view of an alternate embodiment of the present invention along line 6—6 of FIG. 8.
Figure 10:
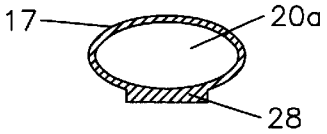
FIG. 10 is a sectional view of an alternate embodiment of the present invention along line 7—7 of FIG. 8.
Figure 8:
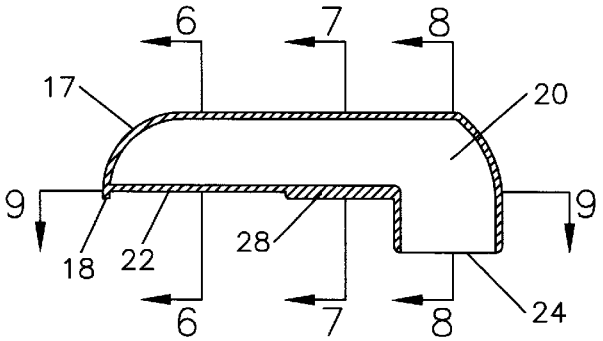
FIG. 8 is a sectional view of an alternate embodiment of the present invention along line 5—5 of FIG. 7.
Figure 11:
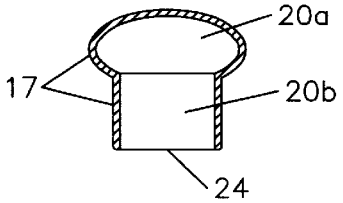
FIG. 11 is a sectional view of an alternate embodiment of the present invention along line 8—8 of FIG. 8.
Figure 12:
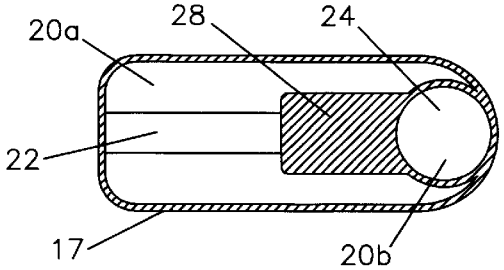
FIG. 12 is a sectional view of an alternate embodiment of the present invention along line 9—9 of FIG. 8.

FIG. 7 shows a perspective view of alternate embodiment 26 with an outer shell 17. It is typically manufactured in two halves from corrosion and sunlight resistant plastic, metal, or other suitable materials all having a specific gravity greater than that of water, then mechanically, chemically, or thermally joined, as along section line 5—5, to form a one piece unit.

FIGS. 8 through 12, 14, and 15 show sectional, front, and side views, respectively, of alternate embodiment 26 wherein like numerals represent like parts. An enclosed priming chamber 20 is held upright by support tab 18 and support ledge 28. Support tab 18 also acts as a water and debris deflector, and has a width less than gutter bottom 13 width typically shown in FIGS. 1*a* and 14. Support ledge 28 is the same width as support tab 18, and is of a length suitable to span across various sized downspout openings.

Priming chamber 20 is comprised of an inlet opening 22, a horizontal chamber 20*a*, a vertical chamber 20*b*, and an outlet opening 24. Inlet opening 22 is positioned above and between support tab 18 and support ledge 28 at an elevation slightly higher than gutter bottom 13 shown in FIGS. 1*a* and 15. Inlet opening 22 can be a slot or a series of holes but is sized to approximate the flow capacity of vertical chamber 20*b*. The elevation of inlet opening 22 should be selected such that passage of median sized debris which could obstruct inlet opening 22 would be prevented and trapped between the lateral gap 21 formed by support tab 18, outer shell 17, support ledge 28, and gutter bottom 13. Horizontal chamber 20*a* can be of any desirable shape, but is intended to have its upper surface elevation as low as possible in relation to the top edge elevation of gutter 12, and sized to approximate the flow capacity of vertical chamber 20*b*. Vertical chamber 20*b* communicates directly with horizontal chamber 20*a* and can be of any desirable shape, but is intended to approximate the flow capacity and loosely fit into gutter opening 15, shown in FIGS. 14, and 15. Outlet opening 24 is the downward limit of vertical chamber 20*b* and terminates at an elevation lower than inlet opening 22 into downspout 14.

In the alternate embodiment, horizontal chamber 20*a* is ellipsoidal in shape, and vertical chamber 20*b* is cylindrical in shape.

OPERATION OF ALTERNATE L-SHAPED EMBODIMENT—FIGS. 8, 9, 14 AND 15

Over time, debris in the form of leaves, pine needles, trash, silt, tennis balls, and the like is transported by gravity, rain, and wind into roof gutter 12. If left unprotected, gutter opening 15 eventually becomes clogged or obstructed as a result of accumulation and compaction of debris in this area. This occurs during two separate processes. First, during non-rainy periods, debris from trees or other sources falls into gutter 12 by gravity and/or wind and piles up in and around gutter opening 15. Second, during rainy periods or snowmelt, upstream water carries debris downstream which also deposits in and around gutter opening 15. The resulting debris pile covers and obstructs water flow into gutter opening 15 which, over time, causes sediment build up and the production of muck from debris decomposition, which eventually closes gutter opening 15 altogether. The same outcome is experienced when prior-art strainers are used—the resulting debris pile eventually covers and obstructs water flow through these devices, and shuts down gutter opening 15 altogether.

Figure 14:
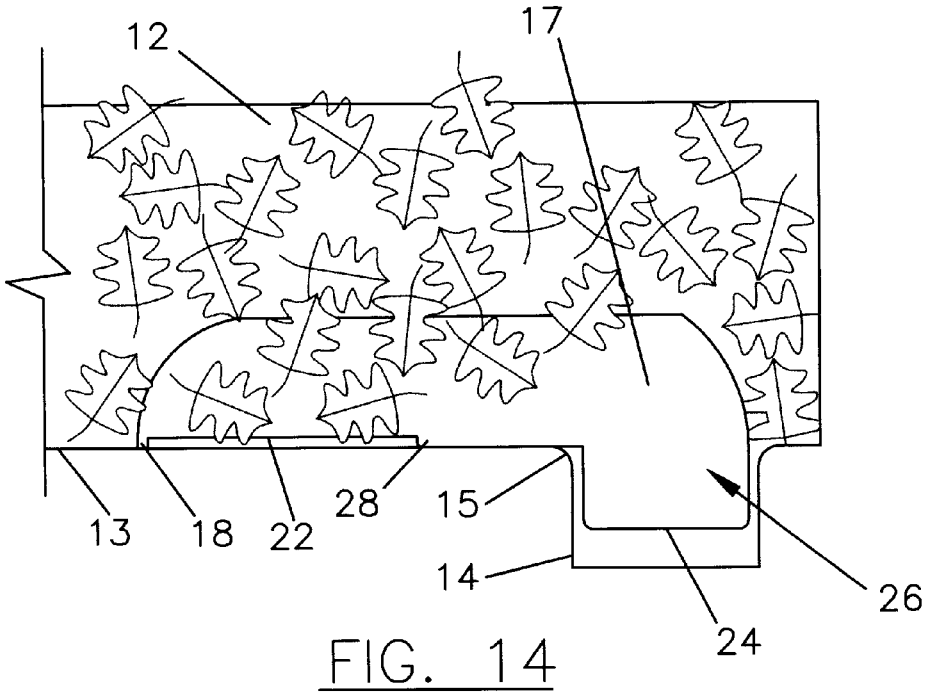
FIG. 14 is a front view of an alternate embodiment of the present invention installed in a typical gutter/downspout arrangement which illustrates its debris deflecting characteristics.

Installation of alternate embodiment 26 prevents this from occurring. Referring now to FIGS. 14 and 15, alternate embodiment 26 is inserted into gutter opening 15 and positioned onto gutter bottom 13 upon support tab 18 and support ledge 28. As debris accumulates around outer shell 17, it forms a tight matrix from twigs, leaf stems, pine needles, and the like which form numerous voids. These voids convey water through the debris matrix which, depending on the flow volume, cause the water to drain or pool through and around outer shell 17.

Operation of alternate embodiment 26 can occur in either one of two phases: priming phase or siphon phase. Operation in the priming phase is most common, and exists during initial and/or low flow conditions. During rainstorms or snowmelt, water flows through debris pile voids and initially drains through downspout gaps 19 which exist between gutter opening 15 and outer shell 17 of vertical chamber 20*b*. As flow volume increases and overwhelms these downspout gaps 19 water level rises and passes between support tab 18 and support ledge 28, and through inlet opening 22 where it creates an air seal, and enters priming chamber 20. Flow continues through horizontal chamber 20*a* and vertical chamber 20*b* until it concludes with discharge through outlet opening 24 into downspout 14. This stage of water drainage is governed by gravity and acts to prime the inner walls of horizontal chamber 20*a* and vertical chamber 20*b*.

The siphon phase develops when water elevation in gutter 12 rises to a level where alternate embodiment 26 becomes submerged. At this point, horizontal chamber 20*a* and vertical chamber 20*b* become fully primed with water and cause airless flow to develop. During this phase, negative water pressure is generated at inlet opening 22 which produces high velocity flow, and causes small debris adjacent to this area, to be sucked into priming chamber 20. This feature prevents sediment and muck build-up, and provides a self-cleaning mechanism which is maintenance free, and independent of the forces of nature for debris removal. Flow volume is also maximized during this phase since water is delivered in a greater quantity to downspout 14 than would normally be experienced during gravity flow which is mixed with air. Therefore, flow during the siphon phase also effectively increases drainage capacity of an existing gutter system.

Airless flow continues until the water level in gutter 12 drops to the elevation of inlet opening 22, and breaks the air seal created during the priming phase. At this point, gravity flow resumes until all water in gutter 12 has been removed either through inlet opening 22 or through the small gaps between gutter opening 15 and outer shell 17 of vertical chamber 20*b*.

SUMMARY, RAMIFICATIONS, AND SCOPE OF INVENTION

Thus the reader will see that the drain guard of this invention is an easily installed device that prevents downspout clogging, and effectively provides for continuous drainage of a gutter filled with debris. The drain guard of this invention can be constructed from common materials which are resistant to temperature changes, ultra-violet light, and various other weathering affects. Furthermore, the drain guard has the additional advantages in that:

- it indirectly separates debris from the water flow to prevent direct obstruction at its drainage inlet;
- it increases available downspout flow capacity when operating as a siphon;
- it features high flow rates near the drain entrance when operating as a siphon which discourages fine particle sedimentation and debris decomposition;
- it is maintenance free and easily removed for gutter cleaning;
- it operates within a debris filled environment, and does not depend on the forces of nature to clear accumulated debris; and
- it easily and quickly manufactured.

While my above description contains many specificities, these should not be construed as limitations on the scope of invention, but rather as an exemplification of two available embodiments thereof. Many other variations are possible. For example, the priming chamber can be other shapes, such as rectangular, circular, triangular, etc.; the support tabs/ledge can be other shapes, such as posts, or notches, be positioned in different locations, such as opposite ends of the horizontal chamber or other suitable locations etc. Embodiments of the invention can be molded and incorporated into the downspout-transition section of the gutter system. Other embodiment applications can include insertion into sink drains used in industrial, commercial, or residential environments where debris from machining, food preparation, or the like would obstruct the drain opening, etc. Yet another application would be use as a drainage control structure in a detention basin as part of a storm water control system.

Accordingly, the scope of the invention should be determined not by the embodiments illustrated, but by the appended claims and their legal equivalents.

I claim:

1. A self-priming drain guard siphon comprising an outer shell having an upper surface and side surfaces, said upper and side surfaces being imperforate, said outer shell defining an inner priming chamber comprised of a substantially horizontal elongated chamber with a plurality of elevated inlet openings on its underside wholly in communication with a substantially elongated vertical chamber which forms a means to transmit fluid between a lower level of a reservoir and a fluid accepting conduit; said underside of the horizontal elongated chamber further comprising a plurality of support tabs which hold said inlet openings at a predetermined elevation, and which are prepositioned for seating engagement onto said lower level of said reservoir.

2. A self-priming siphon strainer comprising:

(a) an outer shell a having an upper surface and side surfaces, said upper surface and side surfaces being imperforate;

(b) an inner priming chamber comprised of a substantially horizontal elongated chamber with an elevated inlet opening on its underside wholly in communication with a substantially elongated vertical chamber; said underside of the horizontal elongated chamber further comprising a plurality of supports which hold said inlet openings at a predetermined elevation, and which are prepositioned for seating engagement onto said lower level of said reservoir, and (c) which forms a means to transmit fluid between a lower level of a reservoir and a fluid accepting conduit.

3. A drain protection device to be used in conjunction with rain guttering, with said guttering having a trough portion connected to a downspout portion, with said trough portion having side walls and a bottom surface, said device comprising:

a horizontal outer shell defining a horizontal chamber, said horizontal outer shell having a length, an end, an upper surface and side surfaces, said upper surface and side surface being imperforate, said outer shell defining an inlet opening, said inlet opening positioned in a lower portion of said horizontal outer shell and elevated off of said bottom surface, said inlet opening for receiving a flow of liquid, a vertical tubular outer shell defining a vertical chamber, said vertical tubular outer shell having a top end and a bottom end, said top end affixed to said lower portion of said horizontal shell, said bottom end for placement in a drain connected to said bottom surface, said vertical chamber in communication with said horizontal chamber for receiving liquid from said horizontal chamber, and support tabs affixed to said horizontal outer shell for elevating said inlet opening off of said bottom surface.

* * * * *